US008966822B2

(12) United States Patent
Sofianek et al.

(10) Patent No.: US 8,966,822 B2
(45) Date of Patent: Mar. 3, 2015

(54) AIR AND DEBRIS DAM FOR MOVING COIL BALANCE ASSEMBLY

(71) Applicant: Caldwell Manufacturing Company North America, LLC, Rochester, NY (US)

(72) Inventors: Jay Sofianek, Webster, NY (US); Wilbur James Kellum, III, Hilton, NY (US); John Kessler, Henrietta, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 13/963,448

(22) Filed: Aug. 9, 2013

(65) Prior Publication Data

US 2014/0041309 A1 Feb. 13, 2014

Related U.S. Application Data

(60) Provisional application No. 61/681,863, filed on Aug. 10, 2012.

(51) Int. Cl.

| | |
|---|---|
| ***E06B 7/16*** | (2006.01) |
| ***E06B 7/23*** | (2006.01) |
| *E06B 3/44* | (2006.01) |
| *E05D 13/00* | (2006.01) |

(52) U.S. Cl.

CPC ..... *E06B 7/16* (2013.01); *E06B 7/2301* (2013.01); *E06B 7/2305* (2013.01); *E06B 3/44* (2013.01); *E05D 13/1276* (2013.01)

USPC ..... 49/430; 49/445; 16/193

(58) Field of Classification Search

USPC ..... 49/445, 447, 429, 430, 181; 16/193, 16/194, 196–198, 202, 206, 208, 211, 214

See application file for complete search history.

(56) References Cited

U.S. PATENT DOCUMENTS

| | | | | |
|---|---|---|---|---|
| 5,661,927 | A * | 9/1997 | Polowinczak et al. | 49/447 |
| 6,584,644 | B2 * | 7/2003 | Braid et al. | 16/197 |
| 6,802,156 | B2 * | 10/2004 | Sherrett et al. | 49/445 |
| 6,848,148 | B2 * | 2/2005 | Braid et al. | 16/197 |
| 7,076,835 | B2 * | 7/2006 | Harold et al. | 16/197 |
| 7,937,809 | B2 * | 5/2011 | Tuller | 16/193 |
| 8,096,081 | B2 * | 1/2012 | Sees | 49/428 |
| 2003/0217514 | A1 * | 11/2003 | Sherrett et al. | 49/445 |
| 2008/0047099 | A1 * | 2/2008 | Malek | 16/197 |
| 2011/0239402 | A1 * | 10/2011 | Steen et al. | 16/197 |
| 2012/0297687 | A1 * | 11/2012 | Baker et al. | 49/414 |
| 2012/0311934 | A1 * | 12/2012 | Abramson et al. | 49/50 |

FOREIGN PATENT DOCUMENTS

WO WO2011/100280 * 8/2011

* cited by examiner

*Primary Examiner* — Katherine Mitchell
*Assistant Examiner* — Justin Rephann
(74) *Attorney, Agent, or Firm* — Harness, Dickey & Pierce, P.L.C.

(57) ABSTRACT

An air and/or debris dam for moving coil balance assembly for a hung window is disclosed. The air and/or debris dam is located between the carrier and a mounting location of a moving coil window balance assembly. The air and/or debris dam can travel within the jamb channel of a window frame assembly to inhibit airflow and/or the deposition of dust and/or debris in the jamb channel.

15 Claims, 7 Drawing Sheets

AIR AND DEBRIS DAM FOR MOVING COIL BALANCE ASSEMBLY

CROSS-REFERENCE TO RELATED APPLICATIONS

This application claims the benefit of U.S. Provisional Application No. 61/681,863, filed on Aug. 10, 2012. The entire disclosure of the above application is incorporated herein by reference.

FIELD

The present disclosure relates to an air and/or debris dam for moving coil balance assembly for a hung window. More particularly, the disclosure pertains to a device located between the carrier and a mounting location of a moving coil window balance assembly that travels within the jamb channel of a window frame assembly to inhibit airflow and/or the deposition of dust and/or debris in the jamb channel.

BACKGROUND

This section provides background information related to the present disclosure which is not necessarily prior art.

Modern window assemblies in residential, commercial and industrial buildings may include one or more window sashes that are movable within a window jamb. Window sashes that move vertically to open and close often include two or more window balance assemblies. The balance assemblies urge the window sash upward (i.e., toward an open position for a lower sash or toward a closed position for an upper sash) to assist a user in moving the window sash and to retain the window sash at a position selected by the user.

The window jambs are positioned on either side of the window sash and form jamb channels in the window frame along which the window balance carrier traverses as the window sash is opened and closed. Adequate clearance is provided in the jamb channels to permit the carriers to move freely up and down. As a result of the movement of the carriers, however, there is a "chimney effect" that permits air and airborne dust and debris to flow into and through the jamb channel. This potentially adversely impacts the free movement of the window sash in the jamb channel. For example, as dust or dirt particles enter the jamb channel, they can deposit on the walls of the jamb channel. An increase in friction between the carrier and the jamb, or some other interference or degradation in the free movement of the carrier, may result causing the force needed to move the window sash to increase.

SUMMARY

This section provides a general summary of the disclosure, and is not a comprehensive disclosure of its full scope or all of its features.

In one aspect, the present disclosure provides an air and debris dam that primarily serves to obstruct airflow through the jamb channel and provide a barrier to inhibit the proliferation of debris in the jamb channel.

In another aspect of the present disclosure, an air and debris dam can be included as a separate component installed after construction of the window assembly or as part of a window balance assembly that is installed during construction of the window assembly.

In another aspect of the present disclosure, an air dam and a debris dam can be individual components of a window balance assembly, or can be combined into a single component.

An air and/or debris dam for moving coil balance assembly for a hung window is provided. The air and/or debris dam can be located between the carrier and a mounting location of a moving coil window balance assembly. The air and/or debris dam can travel within the jamb channel of a window frame assembly to inhibit airflow and/or the deposition of dust and/or debris in the jamb channel.

In yet another aspect, the disclosure provides an air and debris dam for installation in a jamb channel of a hung window assembly between a carrier assembly of a moving coil balance assembly and a tilt latch of a window sash. The jamb channel can have a width and a depth and be defined by a first wall, a second wall opposite the first wall, and third and fourth walls disposed perpendicular to the first and second walls. The first wall can have a vertically extending slot. The air and debris dam can include a base portion having a generally rectangular prism geometry having a first dimension corresponding to the width of the jamb channel, and a second dimension corresponding to the depth of the jamb channel.

The air and debris dam can be movable vertically upward in the jamb channel in response to the carrier assembly bearing against lower end of the base portion and movably vertically downward in the jam channel in response to the tilt latch bearing against upper end of the base portion.

The air and debris dam can be formed from a light-weight, cellular foam-type resilient material that is flexible and elastically deformable. The air and debris dam can include a projection portion projecting outward from the vertically extending slot when the air and debris dam is installed within the jamb channel.

In still another aspect of the disclosure, a window balance assembly for installation within a jamb channel of a window jamb in a hung window is provided and includes a carrier assembly configured to engage a window sash and housing a curl spring, a mounting bracket fixed to the window jamb, positioned vertically above the carrier assembly and configured to engage an uncurled end of the curl spring, and an air dam having a generally rectangular prism geometry. The air dam is positioned within the jamb channel between the carrier assembly and the mounting bracket. The air dam is independently movable along an uncurled portion of the curl spring between the carrier assembly and the mounting assembly. Further, the window balance assembly can include a debris dam having a generally rectangular prism geometry. The debris dam is positioned above the carrier. Each of the air dam and the debris dam can have an opening to enable the uncurled end of the curl spring to pass therethrough.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
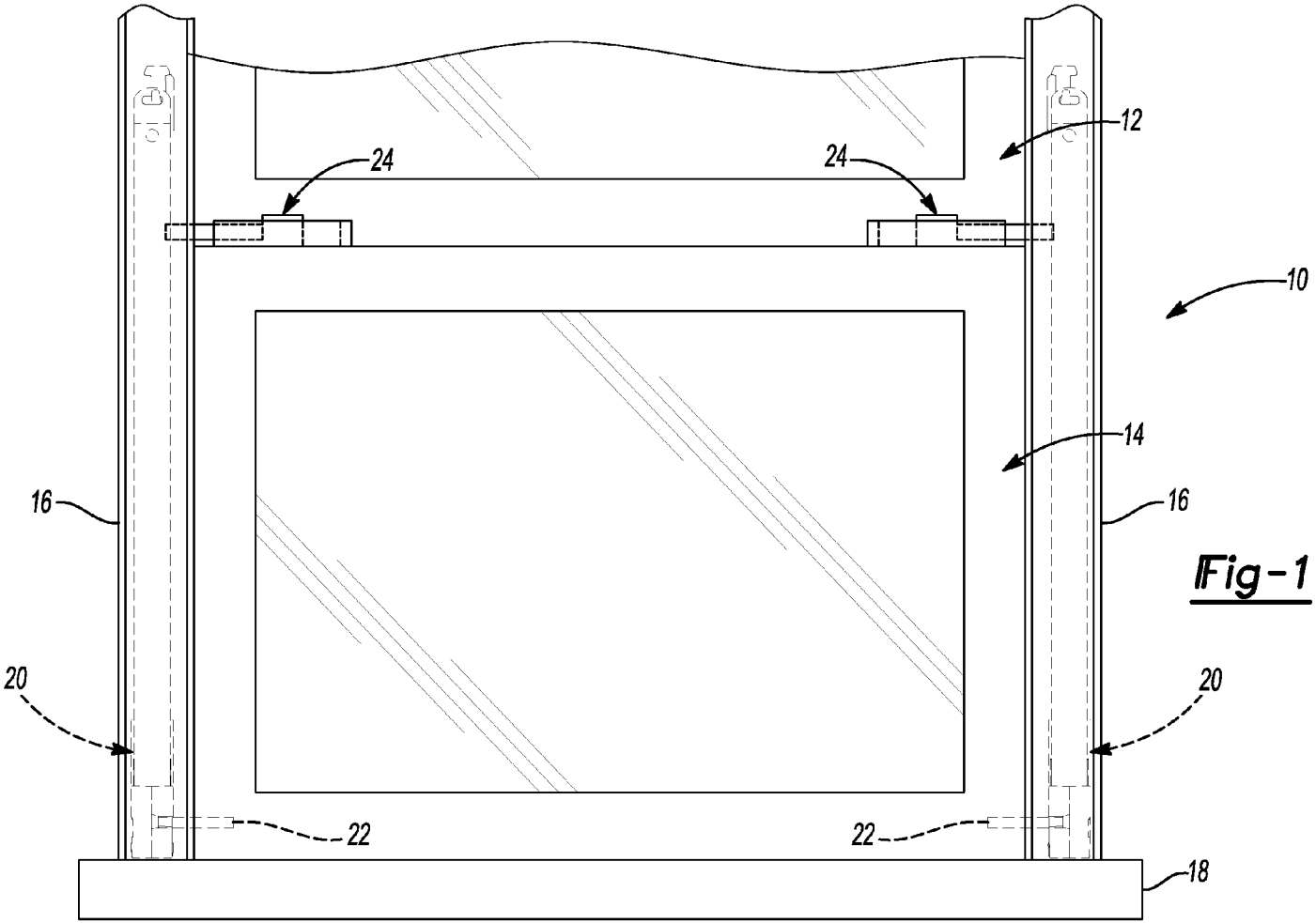
FIG. 1 is a partial front view of a window assembly.

With reference to FIG. 1, a window assembly 10 is provided that may include an upper sash 12, a lower sash 14, a pair of window jambs 16, a window sill 18, and two or more window balance assemblies or cartridges 20. In the particular embodiment illustrated in FIG. 1, the upper sash 12 is fixed relative to the window sill 18 (i.e., in a single hung window assembly). However, in some embodiments, the upper sash 12 may be movable relative to the window sill 18 between a raised or closed position and a lowered or open position (i.e., in a double hung window assembly). The lower sash 14 may be raised and lowered between open and closed positions and may be connected to the window balance assemblies 20 which assist a user in opening the lower sash 14 and maintain the lower sash 14 in a desired position relative to the window sill 18.

Figure 2:
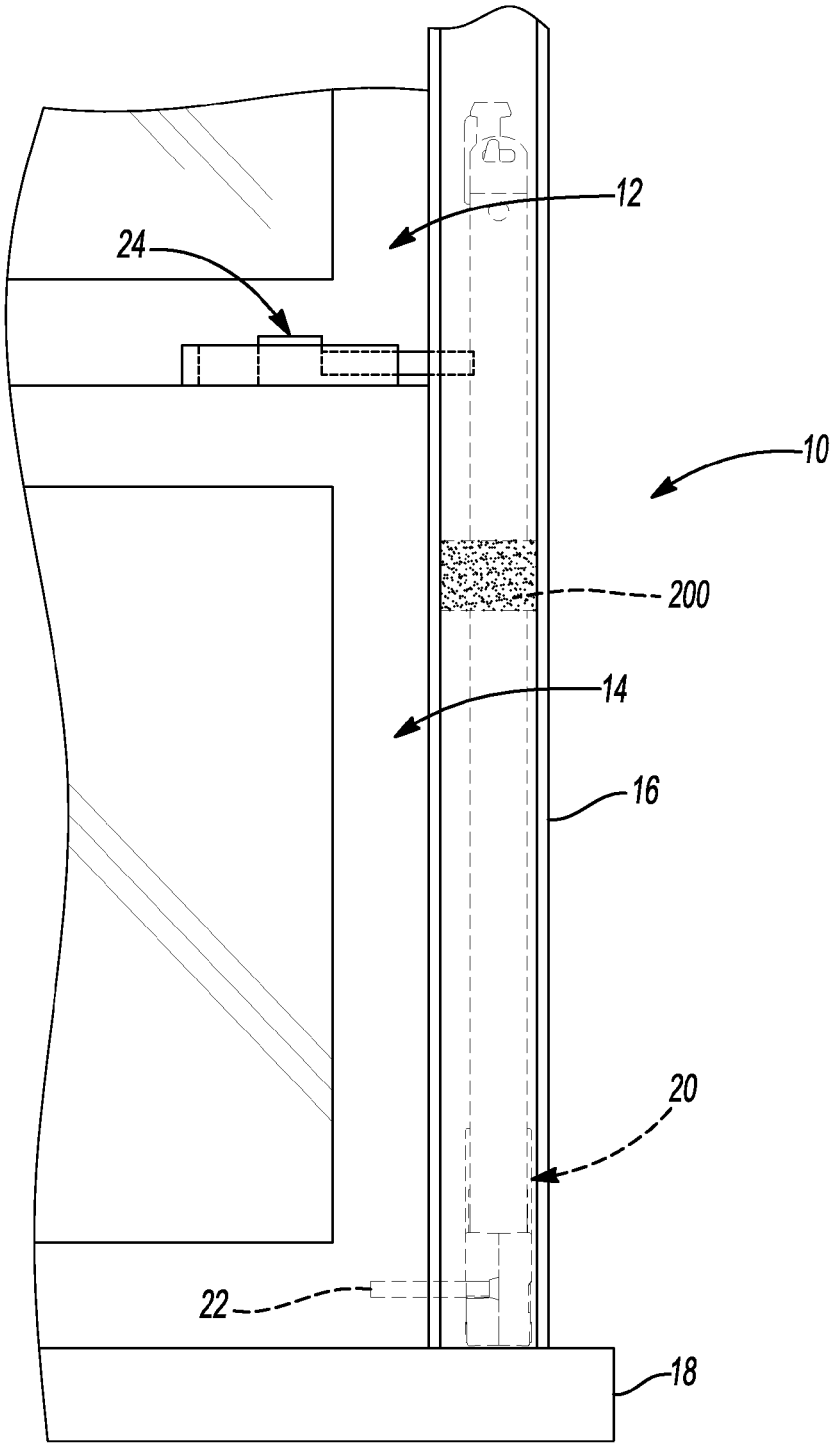
FIG. 2 is a partial view of the window assembly of FIG. 1 and incorporating the air and debris dam according to the principles of the present disclosure.

As shown in FIGS. 1 and 2, the lower sash 14 may include a pair of pivot bars 22 and a pair of tilt latch mechanisms 24. The pivot bars 22 may extend laterally outward in opposing directions from a lower portion of the lower sash 14 and may engage corresponding ones of the window balance assemblies 20. The tilt latch mechanisms 24 may extend laterally outward in opposing directions from an upper portion of the lower sash 14 and may selectively engage corresponding ones of the window jambs 16. The tilt latch mechanisms 24 may be selectively actuated to allow the lower sash 14 to pivot about the pivot bars 22 relative to the window jambs 16 to facilitate cleaning of an exterior side of the window assembly 10, for example.

It will be appreciated that in a double hung window assembly, the upper sash 12 may also be connected to two or more window balance assemblies to assist the user in opening the upper sash 12 and maintaining the upper sash 12 in a selected position relative to the window sill 18. In such a window assembly, the upper sash 12 may also include tilt latches and pivot bars to allow the upper sash 12 to pivot relative to the window jambs 16 in the manner described above.

Figure 3:
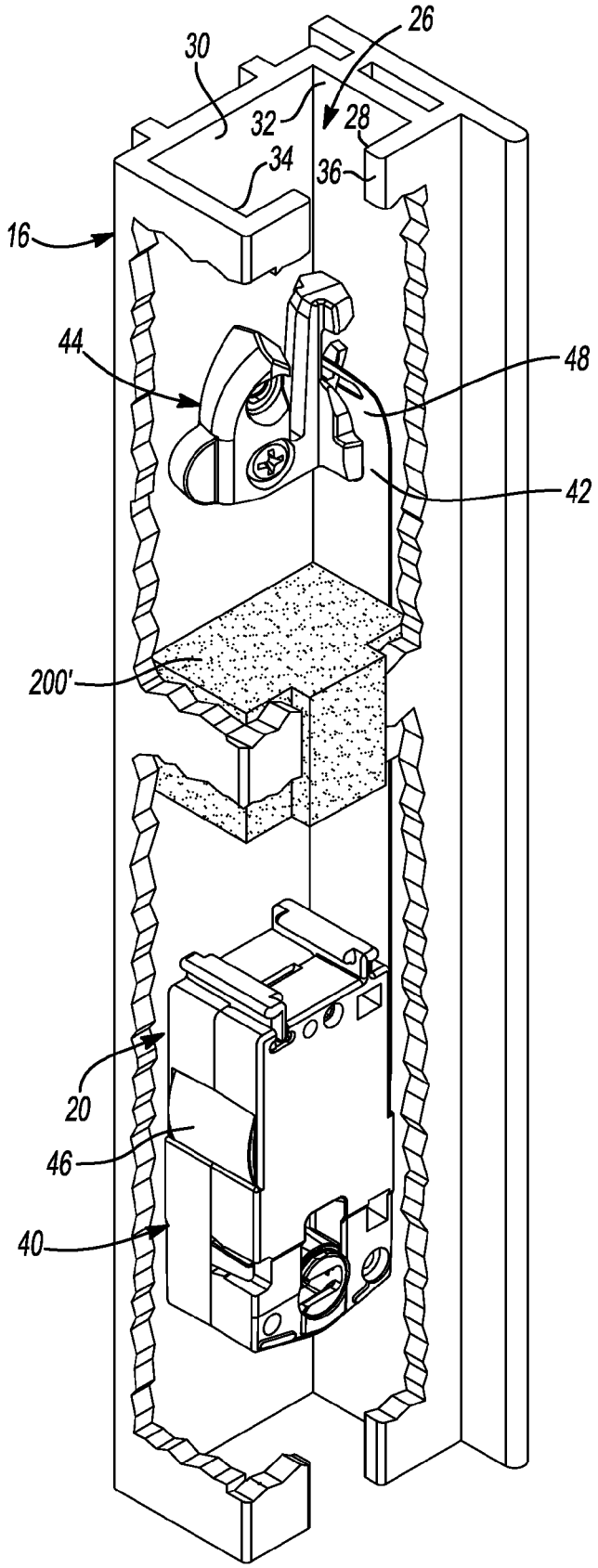
FIG. 3 illustrates a perspective view of a window jamb including an exemplary air and debris dam according to the principles of the present disclosure.

Each of the window jambs 16 may include a jamb channel 26 defined by a first wall 28, a second wall 30 opposite the first wall 28, and third and fourth walls 32, 34 disposed perpendicular to the first and second walls 28, 30, as shown in FIG. 3. The first wall 28 may include a vertically extending slot 36 adjacent the window sash. The slot 36 divides the first wall 28 into a first portion 28-1 and a second portion 28-2. The window balance assembly 20 may be installed within the jamb channel 26. The pivot bar 22 may extend through the slot 36 and into the jamb channel 26 to engage the window balance assembly 20. The tilt latch mechanism 24 may also selectively engage the slot 36 to lock the lower sash 14 in an upright position (FIG. 1).

Figure 11:
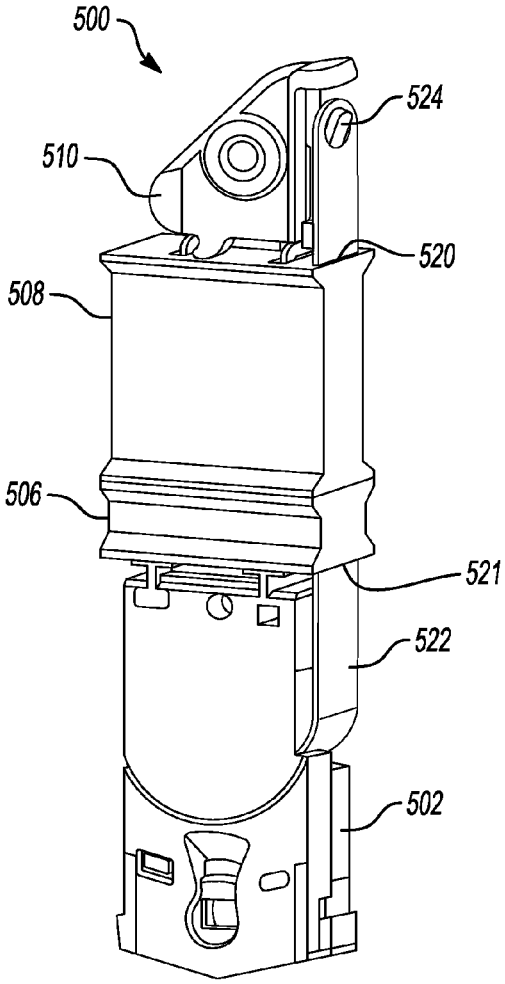
FIG. 11 is a perspective view of the window balance assembly of FIG. 10 in a shipping configuration.

Each of the window balance assemblies 20 may include a carrier 40, a curl spring 42, and a mounting bracket 44. As shown in FIG. 11, for example, the window balance assemblies 20 may be initially assembled and shipped in an uninstalled or shipping configuration and may be subsequently installed onto the window assembly 10 and placed in an installed configuration by a window manufacturer, a construction or renovation contractor, or a homeowner, for example.

The carrier 40 (also referred to as a shoe) may engage the lower sash 14 and house a curled portion 46 of the curl spring 42. As shown in FIG. 3, the mounting bracket 44 may engage an uncurled end portion 48 of the curl spring 42 and may be fixed relative to the window jamb 16. The curl spring 42 may resist being uncurled such that the curl spring 42 exerts an upward force on the carrier 40, thereby biasing the lower sash 14 toward the open position.

One aspect of the present disclosure is an air and debris dam 200, 200', 300, 400 shown in FIGS. 2-9. The air and debris dam 200, 200', 300, 400 primarily serves to obstruct airflow through the jamb channel and provide a barrier to inhibit the proliferation of debris in the jamb channel.

Figure 6:
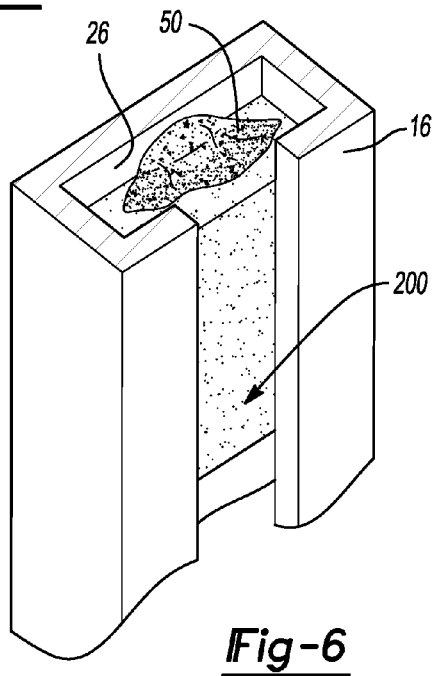
FIG. 6 shows an exemplary air and debris dam according to the principles of the present disclosure as installed in a window jamb and acting as a barrier to debris.

The air and debris dam 200, 200', 300, 400 is preferably formed from a light-weight, cellular foam-type material that is flexible and/or elastically deformable, yet resilient. In this respect, the air and debris dam 200, 200', 300, 400 can be deformed for installation through the slot 36 in the jamb channel 26 of an assembled window 10, and then return to its original size and shape once positioned in the jamb channel 26. The cellular foam material resists the flow of air and can capture debris 50, as shown in FIG. 6.

Figure 4:
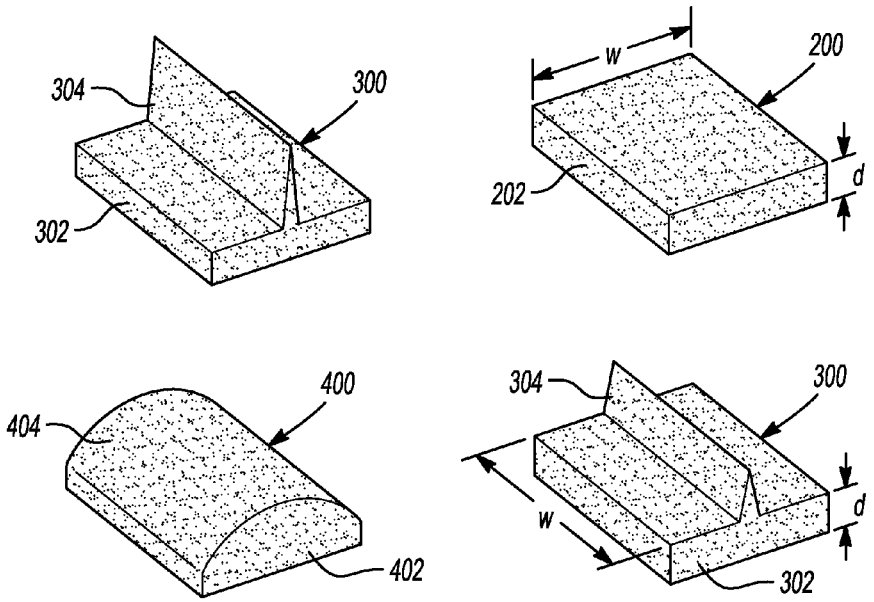
FIG. 4 shows exemplary air and debris dams according to the principles of the present disclosure.

The air and debris dam 200, 200', 300, 400 is sized and shaped to fit generally snugly within the jamb channel 26 of the window jamb 16. Several exemplary embodiments of an air and debris dam 200, 200', 300, 400 are shown in FIGS. 2-9. Referring now to FIG. 4, air and debris dams having various geometries are illustrated. A first exemplary air and debris dam 200 includes a base portion 202 having a generally rectangular prism geometry. The width w and depth d of the base portion 202 substantially correspond to the width W and depth D of the jamb channel 26. As such, when the air and debris dam 200 is installed in a window jamb 16, no portion of the air and debris dam 200 extends beyond the jamb channel 26 and, therefore, the air and debris dam 200 does not come into contact with the lower sash 14.

Figure 7A:
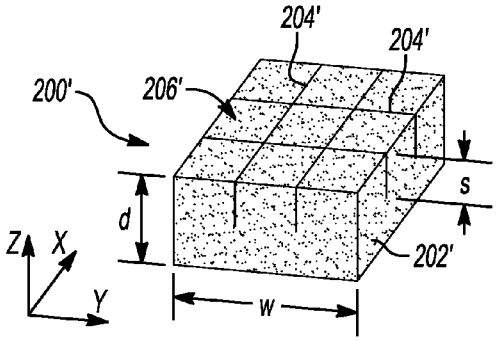
FIGS. 7A and 7B illustrate a perspective view and a cross-sectional side view of one exemplary air and debris dam according to the principles of the present disclosure.
Figure 7B:
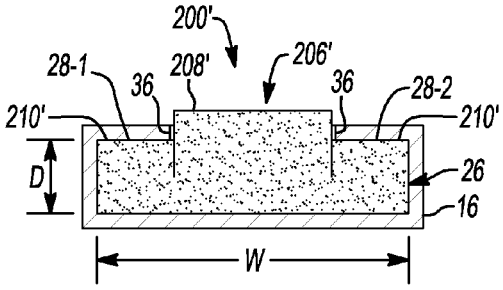

An alternative variation of the air and debris dam 200' is shown in FIGS. 7A and 7B. In the air and debris dam 200', the depth d of the base portion 202' is greater than the depth D of the jamb channel 26. Additionally, the air and debris dam 200' includes one or more scribe cuts or slits 204' in the inner surface 206' (i.e., facing the window sash when installed) of the base portion 202' that extend to a depth s less than the total depth d of the base portion 202'. The scribe cuts 204' can extend in a direction parallel to one or both of a longitudinal X axis and a lateral Y axis. The depth s of the scribe cuts 204' extend in a direction parallel to a Z axis. The scribe cuts 204' enable portions of the air and debris dam 200' to flex or deform relative to one another. As shown in FIG. 7B, then, when installed in a window jamb 16 the air and debris dam 200' occupies the width W and depth D of the jamb channel 26 but also includes a portion 208' that projects outward from the vertically extending slot 36 of the jamb channel 26 and inward toward the lower sash_14. The first and second wall portions 28-1 and 28-2 compressibly engage inner portions 210' such that inner portions 210' are pressed directly against first and second wall portions 28-1 and 28-2. The projection portion 208' can contact or form a seal against the lower sash 14.

Figure 5:
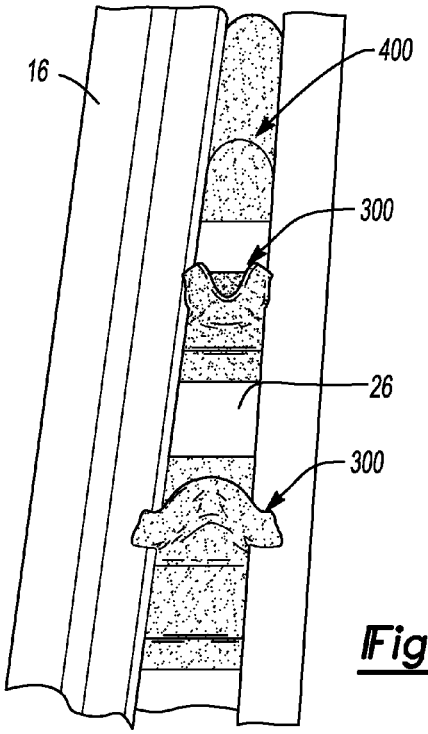
FIG. 5 shows exemplary air and debris dams according to the principles of the present disclosure as installed in a window jamb.
Figure 8A:
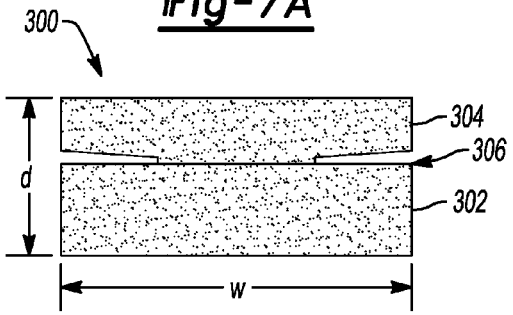
FIGS. 8A, 8B and 8C show a front view, a top view and a cross-sectional side view of another exemplary air and debris dams according to the principles of the present disclosure.
Figure 8B:
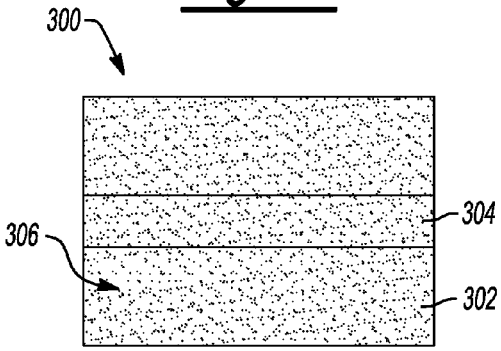
Figure 8C:
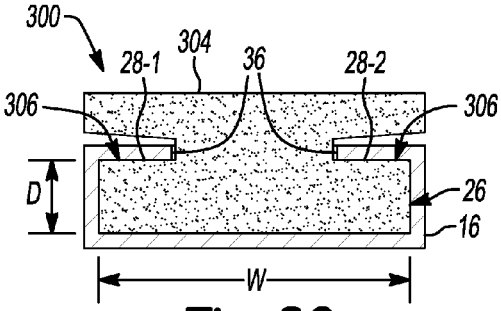

A second exemplary air and debris dam 300 is shown in FIGS. 4, 5, 8A, 8B and 8C. The air and debris dam 300 includes a base portion 302 having a generally rectangular prism geometry and a projection portion 304 extending generally perpendicularly from an inner surface 306 (i.e., facing the window sash when installed) of the base portion 302, and also having a generally rectangular prism geometry. When installed in a window jamb 16, the projection portion 304 of the air and debris dam 300 extends outward from the vertically extending slot 36 of the jamb channel 26 and inward toward the lower sash 14, as shown in FIGS. 5 and 8C. The projection portion 304 of the air and debris dam 300, therefore, can contact or form a seal against the lower sash 14. The first and second wall portions 28-1 and 28-2 compressibly engage the inner surface 306 such that the inner surface 306 is pressed directly against the first and second wall portions 28-1 and 28-2.

It is understood by one skilled in the art that while the embodiment in this disclosure is directed toward a projection portion having a generally rectangular geometry, the geometry of the projection portion could also be circular, triangular, or another suitable shape. It is also understood that, while the embodiment in this disclosure shows the projection portion being integral with the base portion, the projection portion may be a separable piece from the base portion and may be selectively attached to and detached from the base portion as necessary or desired.

Figure 9A:
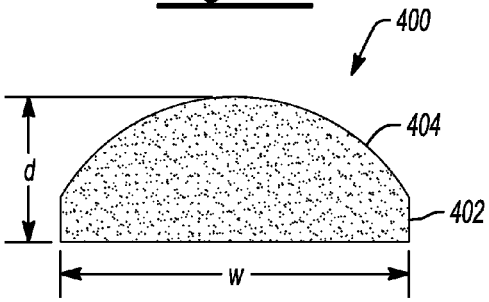
FIGS. 9A and 9B show a front view and a cross-sectional side view of still another exemplary air and debris dam according to the principles of the present disclosure.
Figure 9B:
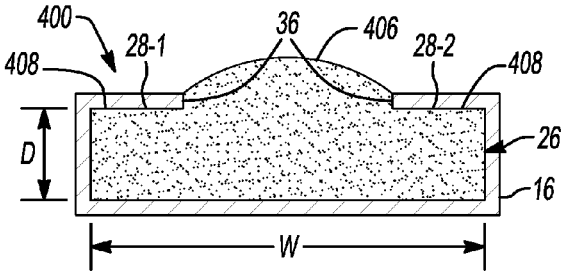

Still another exemplary air and debris dam 400 is shown in FIGS. 4, 5, 9A and 9B. The air and debris dam 400 includes a generally rectangular base 402 and an arcuate surface 404 opposite the base 402. The air and debris dam 400 is dimensioned such that when the air and debris dam 400 is installed in a window jamb 16, a central portion 406 of the arcuate surface 404 extends or projects outward from the vertically extending slot 36 of the jamb channel 26 and inward toward the window sash. The first and second wall portions 28-1 and 28-2 compressibly engage end portions 408 of the arcuate surface 404 such that the end portions 408 are pressed directly against first and second wall portions 28-1 and 28-2. The central portion 406 of the arcuate surface 404 of the air and debris dam 400, therefore, can contact or form a seal against the window sash, as shown in FIGS. 5 and 9B.

Referring now to FIGS. 2 and 3, the air and debris dam 200, 200', 300, 400 is positioned within the jamb channel 26 vertically above the carrier 40 of the window balance assembly 20 and below the tilt latch 24 of the window sash. The air and debris dam 20 is not fixed in the jamb channel 26 and it can freely move vertically within the jamb channel 26. In this regard, vertical movement of the air and debris dam 200, 200', 300, 400 within the jamb channel 26 results as the window sash moves vertically within the window jamb 16. For the example of a single hung window, upward movement of the lower window sash 14 causes corresponding upward movement of the balance carrier 40. As the balance carrier 40 moves in the jamb channel 26, it bears against the lower end of the air and debris dam 200, 200', 300, 400 and thereby urges the air and debris dam 200, 200', 300, 400 upward. Correspondingly, downward movement of the lower window sash 14 causes downward movement of the sash tilt latch 24, which bears against the upper end of the air and debris dam 200, 200', 300, 400 thereby urging the air and debris dam 200, 200', 300, 400 downward. The resiliency of the air and debris dam 200, 200', 300, 400 enables it to maintain its geometry occupying the jamb channel 26 as it is urged by the carrier 40 and tilt latch 24 in the manner described.

The air and debris dam 200, 200', 300, 400 can be a standalone component that is installed in the hung window separately from the window balance assembly 20 before or after construction of the window assembly 10. Alternatively, the air and debris dam 200, 200', 300, 400 can be installed at the same time as the window balance assembly 20 during construction of the window assembly 10.

Figure 10:
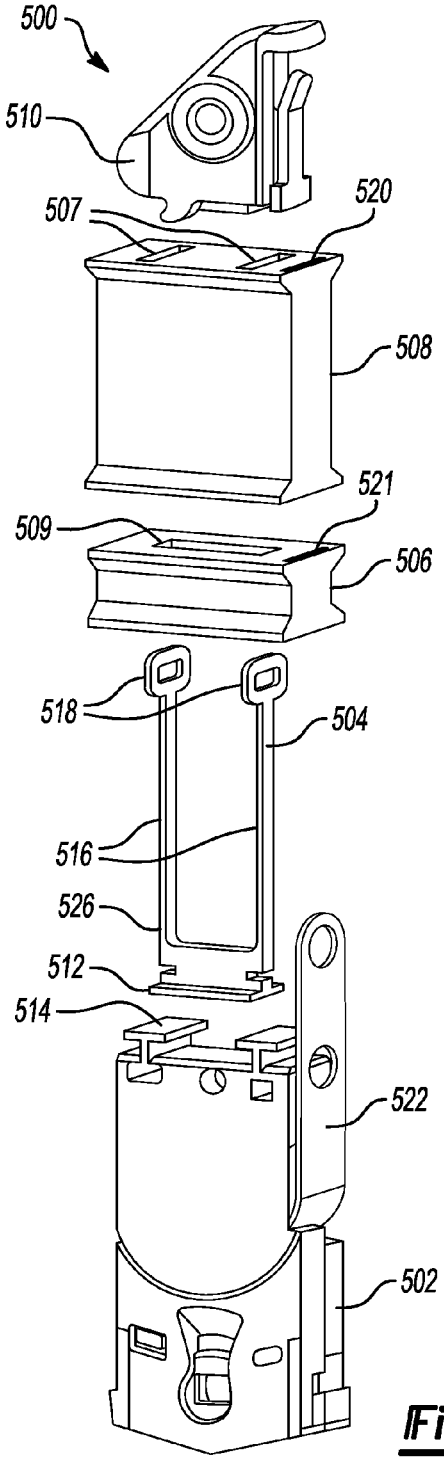
FIG. 10 is an exploded perspective view of window balance assembly incorporating an air dam and a debris dam according to the principles of the present disclosure.
Figure 12:
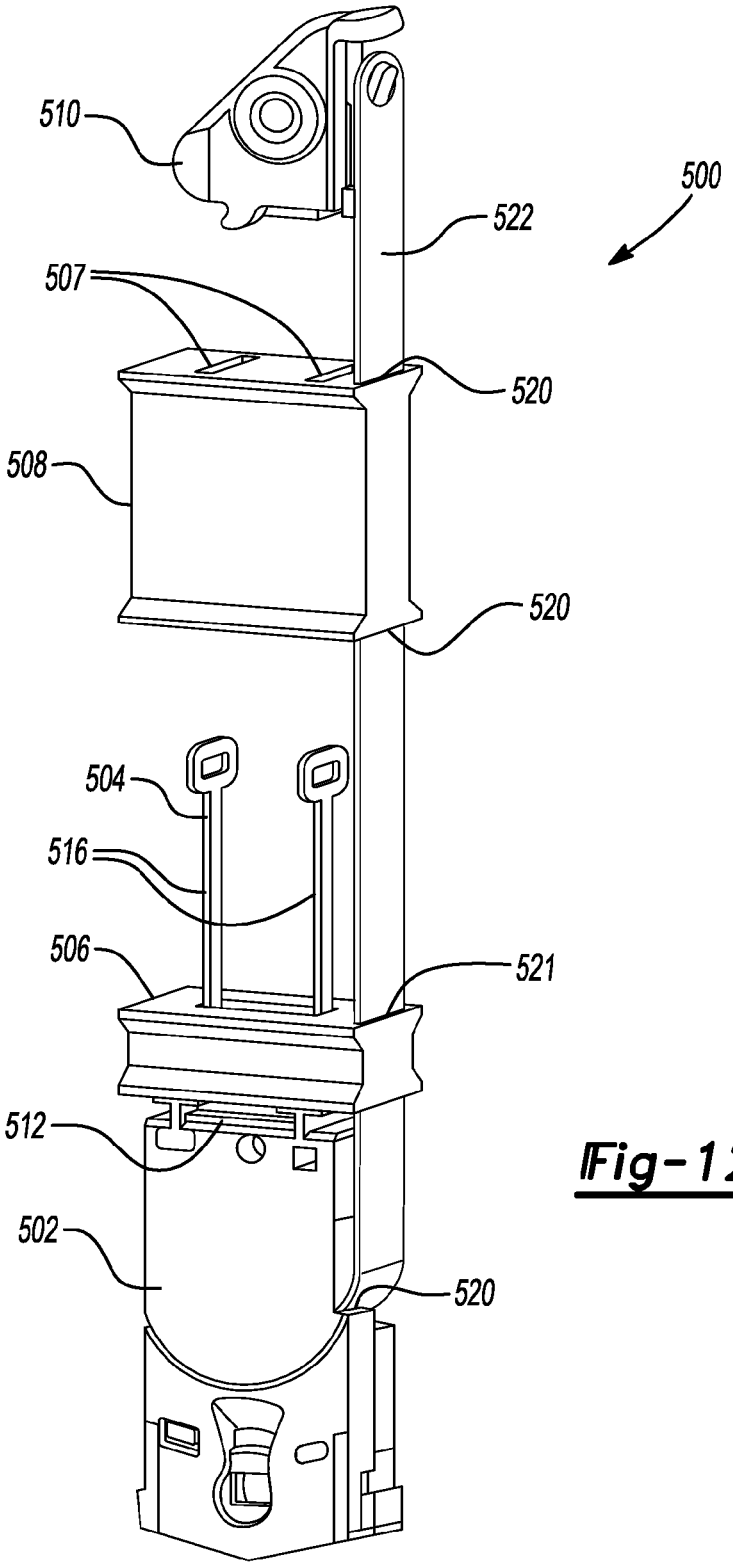
FIG. 12 is a perspective view of the window balance assembly of FIG. 10 in an installed configuration.

The air and debris dam can also comprise an air dam and a debris dam as two separate units. In this respect, another aspect of the present disclosure is shown in FIGS. 10-12. As shown, the air dam and debris dam can be integrated with the window balance assembly. Referring to the exploded view of FIG. 10, the window balance assembly 500 is shown to include a moving coil-type balance carrier 502 (such as that disclosed in International Publication No. WO 2011/100280 A1), a retaining bracket or bridle 504, a debris dam 506, an air dam 508 and a mounting bracket 510 (also such as disclosed in International Publication No. WO 2011/100280 A1). The air dam 508 and the debris dam 506 are each sized and shaped to fit generally snugly within the jamb channel 26 of the window jamb 16.

As shown in FIG. 11, the window balance assembly 500 can be packaged as a cartridge for easy shipping and installation. The bridle 504 is connected to the upper end of the carrier 502 at a base or platform portion 512 that nests with projections 514 formed in the upper end of the carrier's 502 housing. As shown in FIG. 10, the air dam 508 includes openings or slits 507 and the debris dam 506 includes an opening or slit 509. The slits 507, 509 enable the air dam 508 and the debris dam 506 to slide over the legs 516 of the bridle 504 during assembly of the window balance assembly 500. The debris dam 506 is first assembled and is adjacent to the carrier 502. As shown in FIG. 10, the slit 509 is oriented generally perpendicular to the loop portions 518 that are formed at the ends of the legs 516 of the bridle 504. Consequently, when assembling the debris dam 506 over the bridle 504, the loop portions 518 are oriented parallel to the slit 509 to enable the loop portions 518 to easily pass through the slit 509. In this respect, it can be appreciated that the bridle 504 can be made from a flexibly resilient material, such as a thermoplastic, to enable the legs 516 and/or loop portions 518 to be reoriented to accommodate assembly of the debris dam 506 and thereafter return to their original orientation. Once the debris dam 506 is assembled to the bridle 504, then, the loop portions 518 help prevent the debris dam 506 from disassembling from the bridle 504.

The air dam 508 is thereafter assembled on top of the debris dam 506. Also as shown in FIG. 10, the slits 507 are oriented in the same direction as loop portions 518 that are formed at the ends of the legs 516 of the bridle 504, such that the loop portions 508 can easily pass through the slits 507 after installation, so that the air dam 508 can freely move during operation of the window balance assembly.

The mounting bracket 510 then sits on top of the air dam 508 and is connected to the loop portions 518 formed at the ends of the legs 516 of the bridle 504. In addition, as shown in FIGS. 11 and 12, the air dam 508 and debris dam 506 also each include another opening or slit 520, 521 at an end to enable the counter balance spring 522 to pass through them and connect to a hook portion 524 of the mounting bracket 510.

As shown in FIG. 12, at or after installation of the window balance assembly in a window jamb, the mounting bracket 510 is detached from the bridle 504 and a window sash is attached to the carrier 502. The debris dam 506 is maintained in a close relative relationship to the balance carrier 502 by protrusions or barbs 526 included on the legs 516 or base portion 512 of the bridle 504, or another suitable means for retaining a close relative relationship between the components. Consequently, the debris dam 506 moves up and down in the jamb channel 26 with the carrier 502 as the window sash is opened and closed. The air dam 508, however, is not fixed in the jamb channel 26 or relative to the balance carrier 502 and it can freely move vertically within the jamb channel 26 as described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A window balance assembly for installation within a jamb channel of a window jamb in a hung window, the jamb channel having a width and a depth, the window balance assembly comprising:

a carrier assembly configured to engage a window sash and housing a curl spring;

a mounting bracket fixed to the window jamb, positioned vertically above the carrier assembly and configured to engage an uncurled end of the curl spring; and an air dam having a generally rectangular prism geometry, having a first dimension corresponding to the width of the jamb channel and having at least a portion of a second dimension corresponding to the depth of the jamb channel;

a debris dam having a generally rectangular prism geometry;

wherein the air dam is positioned within the jamb channel between the carrier assembly and the mounting bracket;

wherein the air dam is independently movable along an uncurled portion of the curl spring between the carrier assembly and the mounting assembly;

wherein the air dam has a first opening to enable the uncurled end of the curl spring to pass through the air dam; and wherein the debris dam has a second opening to enable the uncurled end of the curl spring to pass through the debris dam.

2. The window balance assembly of claim 1, the debris dam having a third dimension corresponding to the width of the jamb channel, and a fourth dimension corresponding to the depth of the jamb channel;

wherein the debris dam is positioned above the carrier assembly and below the air dam.

3. The window balance assembly of claim 2, wherein the jamb channel comprises a vertically extending slot;

wherein one of the air dam and the debris dam comprises a depth greater than the depth of the jamb channel; and wherein the one of the air dam and the debris dam comprise a projection portion projecting outward from the vertically extending slot when the one of the air and the debris dam is installed within the jamb channel.

4. The window balance assembly of claim 2, wherein at least one of the air dam and the debris dam comprise a cellular foam resilient material that is flexible and elastically deformable.

5. The window balance assembly of claim 1, wherein the carrier assembly comprises a moving coil-type carrier assembly.

6. A window balance assembly for installation within a jamb channel of a window jamb in a hung window, the jamb channel having a width and a depth, the window balance assembly comprising:

a carrier assembly configured to engage a window sash and housing a curl spring;

a mounting bracket fixed to the window jamb, positioned vertically above the carrier assembly and configured to engage an uncurled end of the curl spring; and an air dam having a generally rectangular prism geometry, having a first dimension corresponding to the width of the jamb channel and having at least a portion of a second dimension corresponding to the depth of the jamb channel;

a debris dam having a generally rectangular prism geometry, a third dimension corresponding to the width of the jamb channel, and a fourth dimension corresponding to the depth of the jamb channel, wherein the debris dam is positioned above the carrier assembly and below the air dam;

wherein the air dam is positioned within the jamb channel between the carrier assembly and the mounting bracket;

wherein the air dam is independently movable along an uncurled portion of the curl spring between the carrier assembly and the mounting assembly;

wherein the air dam has a first opening to enable the uncurled end of the curl spring to pass through the air dam; and wherein the debris dam has a second opening to enable the uncurled end of the curl spring to pass through the debris dam.

7. The window balance assembly of claim 6 further comprising a bracket configured to engage an upper end of the carrier assembly and comprising at least one leg;

wherein the at least one leg extends away from the upper end of the carrier assembly;

wherein the debris dam comprises at least one third opening to enable the leg to pass through the debris dam;

wherein the air dam comprises at least one fourth opening to enable the leg to pass through the air dam; and wherein the at least one leg comprises means for maintaining the debris dam in a fixed relative position to the carrier assembly.

8. The window balance assembly of claim 7, wherein the means for maintaining the debris dam in a fixed relative position to the carrier assembly comprises at least one protrusion.

9. The window balance assembly of claim 7, wherein the at least one leg of the bridle comprises a loop portion formed at an upper end of the at least one leg; and wherein the mounting bracket engages the loop portion.

10. An air and debris dam for installation in a jamb channel of a hung window assembly between a carrier assembly of a moving coil balance assembly and a tilt latch of a window sash, the jamb channel having a width and a depth and defined by a first wall, a second wall opposite the first wall, and third and fourth walls disposed perpendicular to the first and second walls, the first wall comprising a vertically extending slot, the air and debris dam comprising:

a base portion having a generally rectangular prism geometry and comprising a first dimension corresponding to the width of the jamb channel and a second dimension corresponding to the depth of the jamb channel; and a projection portion projecting outward from the vertically extending slot when the air and debris dam is installed within the jamb channel;

wherein the base portion comprises a generally rectangular lower portion and a generally arcuate surface opposite the lower portion; and wherein the projection portion projecting outward from the vertically extending slot when the air and debris dam is installed within the jamb channel comprises the arcuate surface.

11. An air and debris dam for installation in a jamb channel of a hung window assembly between a carrier assembly of a moving coil balance assembly and a tilt latch of a window sash, the jamb channel having a longitudinal axis, a width, and a depth and defined by a first wall, a second wall opposite the first wall, and third and fourth walls disposed perpendicular to the first and second walls, the first wall comprising a vertically extending slot, the air and debris dam comprising:

a body having a generally rectangular prism geometry and comprising a first dimension corresponding to the width of the jamb channel and a second dimension corresponding to the depth of the jamb channel, the body comprising:

a plurality of slits in a first face facing the window sash and extending along the longitudinal axis, the plurality of slits having depths that are less than the second dimension of the body; and a projection portion at least partially defined by two of the plurality of slits and having a generally rectangular prism geometry, the projection portion projecting outward from the vertically extending slot when a remainder of the air and debris dam is installed within the jamb channel.

12. The air and debris dam of claim 11, wherein the air and debris dam is movable vertically upward in the jamb channel in response to the carrier assembly bearing against lower end of the base portion; and wherein the air and debris dam is movably vertically downward in the jam channel in response to the tilt latch bearing against upper end of the base portion.

13. The air and debris dam of claim 12, wherein the air and debris dam is formed from a cellular foam resilient material that is flexible and elastically deformable.

14. The air and debris dam of claim 12, wherein the second dimension of the base portion is greater than the depth of the jamb channel.

15. The air and debris dam of claim 14, further comprising the projection portion projecting outward from the vertically extending slot when the air and debris dam is installed within the jamb channel.

* * * * *

UNITED STATES PATENT AND TRADEMARK OFFICE

CERTIFICATE OF CORRECTION

PATENT NO. : 8,966,822 B2
APPLICATION NO. : 13/963448
DATED : March 3, 2015
INVENTOR(S) : Jay Sofianek et al.

It is certified that error appears in the above-identified patent and that said Letters Patent is hereby corrected as shown below:

In the Claims

In Col. 10, Line 27, Claim 12, replace the word “jam” with “jamb”.

Signed and Sealed this
Sixteenth Day of June, 2015

Michelle K. Lee

Michelle K. Lee
*Director of the United States Patent and Trademark Office*